US005806507A

United States Patent [19]

Osanai

[11] Patent Number: 5,806,507

[45] Date of Patent: Sep. 15, 1998

[54] EVAPORATED FUEL TREATMENT DEVICE OF AN ENGINE

[75] Inventor: Akinori Osanai, Susono, Japan

[73] Assignee: Toyota Jidosha Kabushiki Kaisha, Aichi, Japan

[21] Appl. No.: 897,934

[22] Filed: Jul. 21, 1997

[30] Foreign Application Priority Data

Jul. 24, 1996 [JP] Japan ..... 8-194538

[51] Int. Cl.[6] ..... P02D 41/00

[52] U.S. Cl. ..... 123/698

[58] Field of Search ..... 123/698, 674

[56] References Cited

U.S. PATENT DOCUMENTS

| | | | |
|---|---|---|---|
| 5,611,320 | 3/1997 | Hara et al. | 123/698 |
| 5,657,737 | 8/1997 | Ishida et al. | 123/674 |
| 5,682,869 | 11/1997 | Nankee, II et al. | 123/698 |
| 5,694,911 | 12/1997 | Kawamoto et al. | 123/674 |

FOREIGN PATENT DOCUMENTS

| | | | |
|---|---|---|---|
| 61-19962A | 1/1986 | Japan | 123/698 |
| 219631A | 1/1990 | Japan | 123/698 |
| 2245458A | 10/1990 | Japan | 123/698 |
| 62591A | 1/1994 | Japan | 123/698 |
| 6280688A | 10/1994 | Japan | 123/698 |
| 777111A | 3/1995 | Japan | 123/698 |
| 7247919A | 9/1995 | Japan | 123/698 |

*Primary Examiner*—Raymond A. Nelli
*Attorney, Agent, or Firm*—Kenyon & Kenyon

[57] ABSTRACT

An evaporated fuel treatment device comprising a purge control valve arranged between a canister and an intake passage of an engine. A drive pulse of the purge control valve is controlled by a duty ratio. When the purge action starts, the duty ratio is gradually increased. When the amount of the intake air is large other than at engine idling, the purge action is started. After the purge action is started, the purge action is performed even during engine idling.

12 Claims, 15 Drawing Sheets

EVAPORATED FUEL TREATMENT DEVICE OF AN ENGINE

BACKGROUND OF THE INVENTION

1. Field of the Invention

The present invention relates to an evaporated fuel treatment device of an engine.

2. Description of the Related Art

When a large amount of fuel vapor is rapidly purged in an engine intake passage, feedback control of the air-fuel ratio becomes difficult and the air-fuel ratio fluctuates widely. Therefore, known in the art is an internal combustion engine where the air-fuel ratio is prevented from fluctuating widely by gradually increasing the amount of purge of the fuel vapor, that is, gradually increasing the amount of opening of the purge control valve for controlling the amount of purge, when starting the purge action of the fuel vapor (see Japanese Unexamined Patent Publication (Kokai) No. 7-247919).

When gradually increasing the amount of opening of the purge control valve in this way, however, if starting the purge action at the time engine idling when the amount of intake air is small, the problem will arise of the air-fuel ratio fluctuating widely. This will be explained next referring to FIG. 15A and FIG. 15B.

FIG. 15A shows schematically the purge control valve which is generally used. A shows a valve body, B a spring, C a core, and D a solenoid. A drive pulse is applied to the solenoid. By controlling the duty ratio of the drive pulse, the amount of opening of the valve body A is controlled. FIG. 15B shows the relationship between the duty ratio of the drive pulse applied to the solenoid D and the flow rate of the purge. As will be understood from FIG. 15B, when the duty ratio becomes large to a certain extent, the flow rate of the purge is proportional to the duty ratio as shown by the solid line, but when the duty ratio becomes small, the flow rate of the purge no long is proportional to the duty ratio as shown by the broken line.

That is, as shown in FIG. 15A, in a purge control valve, for the valve body A to open, an electromagnetic force of attraction enough to overcome the spring force of the spring B and the force of attraction of the negative pressure acting on the top center of the valve body A is necessary, therefore a large amount of fuel vapor will be purged rapidly in the intake passage. If a large amount of fuel vapor is purged in the intake passage rapidly, the air-fuel ratio will fluctuate widely at the time of engine idling when the amount of intake air is small and as a result not only will the engine speed fluctuate, but also the exhaust emission will deteriorate.

To solve this problem, it is sufficient to stop the purge action at the time of engine idling. If the purge action is stopped at the time of engine idling, however, the chance for purging the fuel vapor will be reduced and the problem will occur of saturation of the ability of the canister to absorb the fuel vapor.

SUMMARY OF THE INVENTION

An object of the present invention is to provide an evaporated fuel treatment device capable of increasing the chances for a purging action while preventing an air-fuel ratio from fluctuating when the purging action is started.

According to the present invention, there is provided an evaporated fuel treatment device for an engine provided with an intake passage, comprising a purge control valve for controlling an amount of purge of fuel vapor to be purged to the intake passage; air-fuel ratio detecting means for detecting the air-fuel ratio; purge action starting means for starting a purge action of fuel vapor when the amount of intake air is larger than a predetermined amount which is greater than the amount of intake air at the time of engine idling; valve opening controlling means for gradually opening the purge control valve from the fully closed state to a target opening degree when the purge action of the fuel vapor is started; and purge action authorizing means for authorizing a purge action of fuel vapor at the time of engine idling after the purge action of the fuel vapor has been started.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
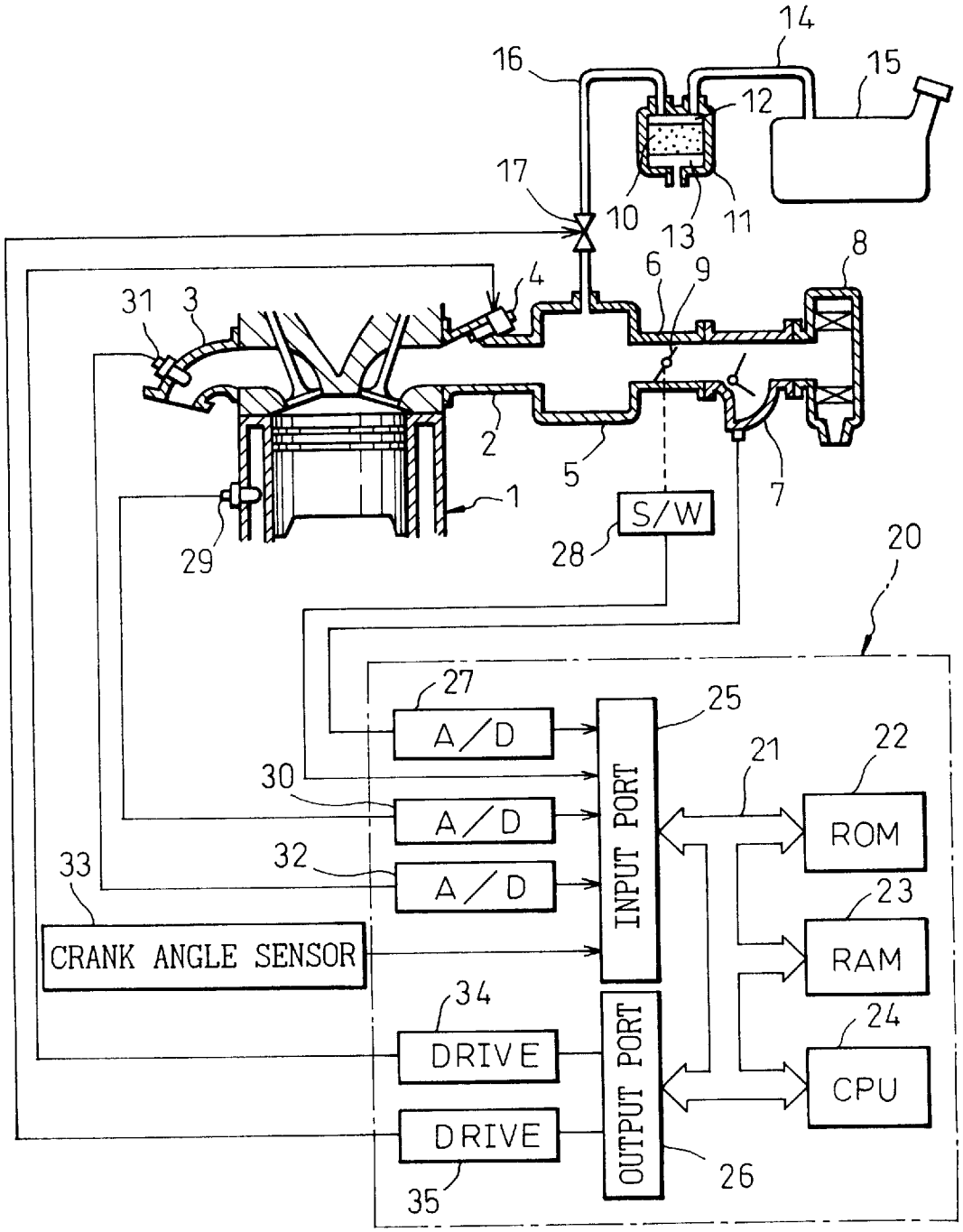
FIG. 1 is an overall view of an internal combustion engine.

Referring to FIG. 1, 1 is an engine body, 2 an intake tube, 3 an exhaust manifold, and 4 a fuel injector attached to each of the intake tubes 2. Each intake tube 2 is connected to a common surge tank 5. The surge tank 5 is connected through an intake duct 6 and an air flow meter 7 to an air cleaner 8. In the intake duct 6 is arranged a throttle valve 9. Further, as shown in FIG. 1, the internal combustion engine has disposed in it a canister 11 containing activated carbon 10. The canister 11 has a fuel vapor chamber 12 and an atmospheric chamber 13 on the two sides of the activated carbon 10. The fuel vapor chamber 12 on the one hand is connected through a conduit 14 to a fuel tank 15 and on the other hand through a conduit 16 to the inside of the surge tank 5. In the conduit 16 is disposed a purge control valve 17 which is controlled by output signals from an electronic control unit 20. The fuel vapor which is generated in the fuel tank 15 is sent through the conduit 14 into the canister 11 where it is absorbed by the activated carbon 10. When the purge control valve 17 opens, the air is sent from the atmospheric chamber 13 through the activated carbon 10 into the conduit 16. When the air passes through the activated carbon 10, the fuel vapor which is absorbed in the activated carbon 10 is released from the activated carbon 10 therefore air containing the fuel vapor is purged through the conduit 16 to the inside of the surge tank 5.

The electronic control unit 20 is comprised of a digital computer and is provided with a read only memory (ROM) 22, a random access memory (RAM) 23, a microprocessor (CPU) 24, an input port 25, and an output port 26 connected to each other through a bidirectional bus 21. The air flow meter 7 generates an output voltage proportional to the amount of the intake air. This output voltage is input through the AD converter 27 to the input port 25. The throttle valve 9 has attached to it a throttle switch 28 which becomes on when the throttle valve 9 is at the idle open position. The output signal of the throttle switch 28 is input to the input port 25. The engine body 1 has attached to it a water temperature sensor 29 for generating an output voltage proportional to the coolant water temperature of the engine. The output voltage of the water temperature sensor 29 is input through the AD converter 30 to the input port 25. The exhaust manifold 3 has an air-fuel ratio sensor 31 attached to it. The output signal of the air-fuel ratio sensor 31 is input through the AD converter 32 to the input port 25. Further, the input port 25 has connected to it a crank angle sensor 33 generating an output pulse every time the crankshaft rotates by for example 30 degrees. In the CPU 24, the engine speed is calculated based on this output pulse. On the other hand, the output port 26 is connected through the corresponding drive circuits 34 and 35 to the fuel injectors 4 and the purge control valve 17.

In the internal combustion engine shown in FIG. 1, the fuel injection time TAU is calculated based fundamentally on the following equation:

$$TAU=TP\cdot\{K+FAF-FPG\}$$

where, the coefficients show the following:

TP: basic fuel injection time

K: correction coefficient

FAF: feedback correction coefficient

FPG: purge A/F correction coefficient

The basic fuel injection time TP is the experimentally found injection time required for making the air-fuel ratio the target air-fuel ratio. The basic fuel injection time TP is stored in advance in the ROM as a function of the engine load Q/N (amount of intake air Q/engine speed N) and the engine speed N.

The correction coefficient K expresses the engine warmup increase coefficient and the acceleration increase coefficient all together. When there is no upward correction is needed, K is made 0.

The purge A/F correction coefficient FPG is for correction of the amount of injection when the purge has been performed. The period from when the engine operation is started to when the purge is started is FPG=0.

The feedback correction coefficient FAF is for controlling the air-fuel ratio to the target air-fuel ratio based on the output signal of the air-fuel ratio sensor 31. As the target air-fuel ratio, any air-fuel ratio may be used, but in the embodiment shown in FIG. 1, the target air-fuel ratio is made the stoichiometric air-fuel ratio, therefore the explanation will be made of the case of making the target air-fuel ratio the stoichiometric air-fuel ratio hereafter. Note that when the target air-fuel ratio is the stoichiometric air-fuel ratio, as the air-fuel ratio sensor 31, a sensor whose output voltage changes in accordance with the concentration of oxygen in the exhaust gas is used, therefore hereinafter the air-fuel ratio sensor 31 will be referred to as an $O_2$ sensor. This $O_2$ sensor 31 generates an output voltage of about 0.9 V when the air-fuel ratio is rich and generates an output voltage of about 0.1 V when the air-fuel ratio is lean. First, an explanation will be made of the control of the feedback correction coefficient FAF performed based on the output signal of this $O_2$ sensor 31.

Figure 2:
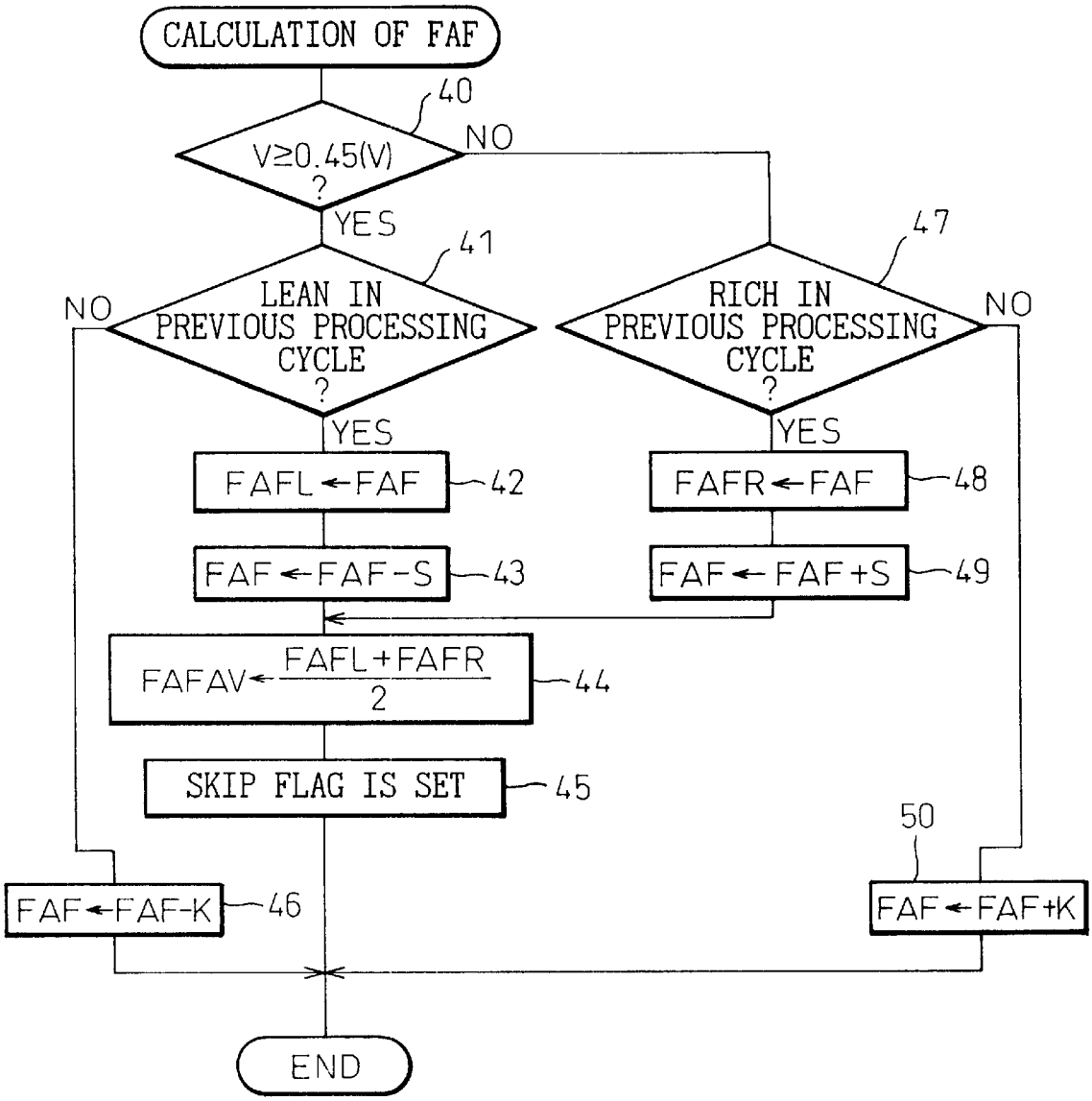
FIG. 2 is a flow chart for calculating an air-fuel ratio feedback correction coefficient FAF.

FIG. 2 shows the routine for calculation of the feedback correction coefficient FAF. This routine is executed for example within a main routine.

Figure 3:
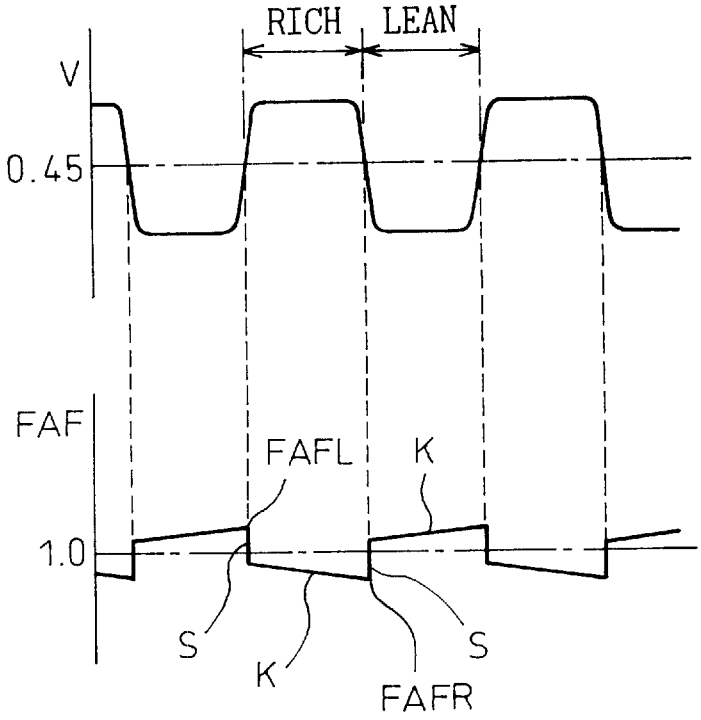
FIG. 3 is a view of the changes in the air-fuel ratio feedback correction coefficient FAF.

Referring to FIG. 2, first, at step 40, it is judged whether the output voltage of the $O_2$ sensor 31 is higher than 0.45 V or not, that is, whether the air-fuel ratio is rich or not. When $V \geqq 0.45$ V, that is, when the air-fuel ratio is rich, the routine proceeds to step 41, where it is judged if the air-fuel ratio was lean at the time of the previous processing cycle or not. When it was lean at the time of the previous processing cycle, that is, when it has changed from lean to rich, the routine proceeds to step 42, where the feedback control coefficient FAF is made FAFL and the routine proceeds to step 43. At step 43, a skip valve S is subtracted from the feedback control coefficient FAF, therefore, as shown in FIG. 3, the feedback control coefficient FAF is rapidly reduced by the skip valve S. Next, at step 44, the average value FAFAV of the FAFL and FAFR is calculated. Next, at step 45, the skip flag is set. On the other hand, when it is judged at step 41 that the air-fuel ratio was rich at the time of the previous processing cycle, the routine proceeds to step 46, where the integral value K (K<<S) is subtracted from the feedback control coefficient FAF. Therefore, as shown in FIG. 2, the feedback control coefficient FAF is gradually reduced.

On the other hand, when it is judged at step 40 that $V<0.45$ V, that is, when the air-fuel ratio is lean, the routine proceeds to step 47, where it is judged if the air-fuel ratio was rich at the time of the previous processing cycle. When it was rich at the time of the previous processing cycle, that is, when it changed from rich to lean, the routine proceeds to step 48, where the feedback control coefficient FAF is made FAFR and the routine proceeds to step 49. At step 49, the skip value S is added to the feedback control coefficient FAF, therefore, as shown in FIG. 3, the feedback control coefficient FAF is rapidly increased by exactly the skip value S. Next, when it was judged at step 44 that the air-fuel ratio was lean at the time of the previous processing cycle, the routine proceeds to step 50, where the integral value K is added to the feedback control coefficient FAF. Therefore, as shown in FIG. 3, the feedback control coefficient FAF is gradually increased.

When the air-fuel ratio becomes rich and FAF becomes smaller, the fuel injection time TAU becomes shorter, while when the air-fuel ratio becomes lean and the FAF increases, the fuel injection time TAU becomes longer, so the air-fuel ratio is maintained at the stoichiometric air-fuel ratio. Note that when the purge action is not performed, as shown in FIG. 3, the feedback control coefficient FAF fluctuates about 1.0. Further, as will be understood from FIG. 3, the average value FAFAV calculated at step 44 shows the average value of the feedback control coefficient FAF.

As will be understood from FIG. 3, the feedback control coefficient FAF is made to change relatively slowly by the integral constant K, so if a large amount of fuel vapor is rapidly purged into the surge tank 5 and the air-fuel ratio rapidly fluctuates, it no longer becomes possible to maintain the air-fuel ratio at the stoichiometric air-fuel ratio and therefore the air-fuel ratio fluctuates. Therefore, in the embodiment shown in FIG. 1, to prevent the air-fuel ratio from fluctuating, when the purge is performed, the amount of the purge is gradually increased. That is, in the embodiment shown in FIG. 1, by controlling the duty ratio of the drive pulse applied to the purge control valve 17, the amount of opening of the purge control valve 17 is controlled. When the purge is started, the duty ratio of the drive pulse is gradually increased. If the duty ratio of the drive pulse is gradually increased in this way, that is, if the amount of purge is gradually increased, even during the increase in the amount of the purge, the air-fuel ratio will be maintained at the stoichiometric air-fuel ratio by the feedback control by the feedback control coefficient FAF, therefore it is possible to prevent the air-fuel ratio from fluctuating.

As mentioned at the start, however, if the amount of opening of the purge control valve 17 is gradually increased when the purge is started, that is, in this embodiment according to the embodiment, if the duty ratio of the drive pulse is gradually increased, there is the problem that the amount of opening of the purge control valve 17 will increase all at once and therefore the air-fuel ratio will fluctuate widely at the time of engine idling when the amount of intake air is small. This will be explained next referring to FIG. 4.

Figure 4:
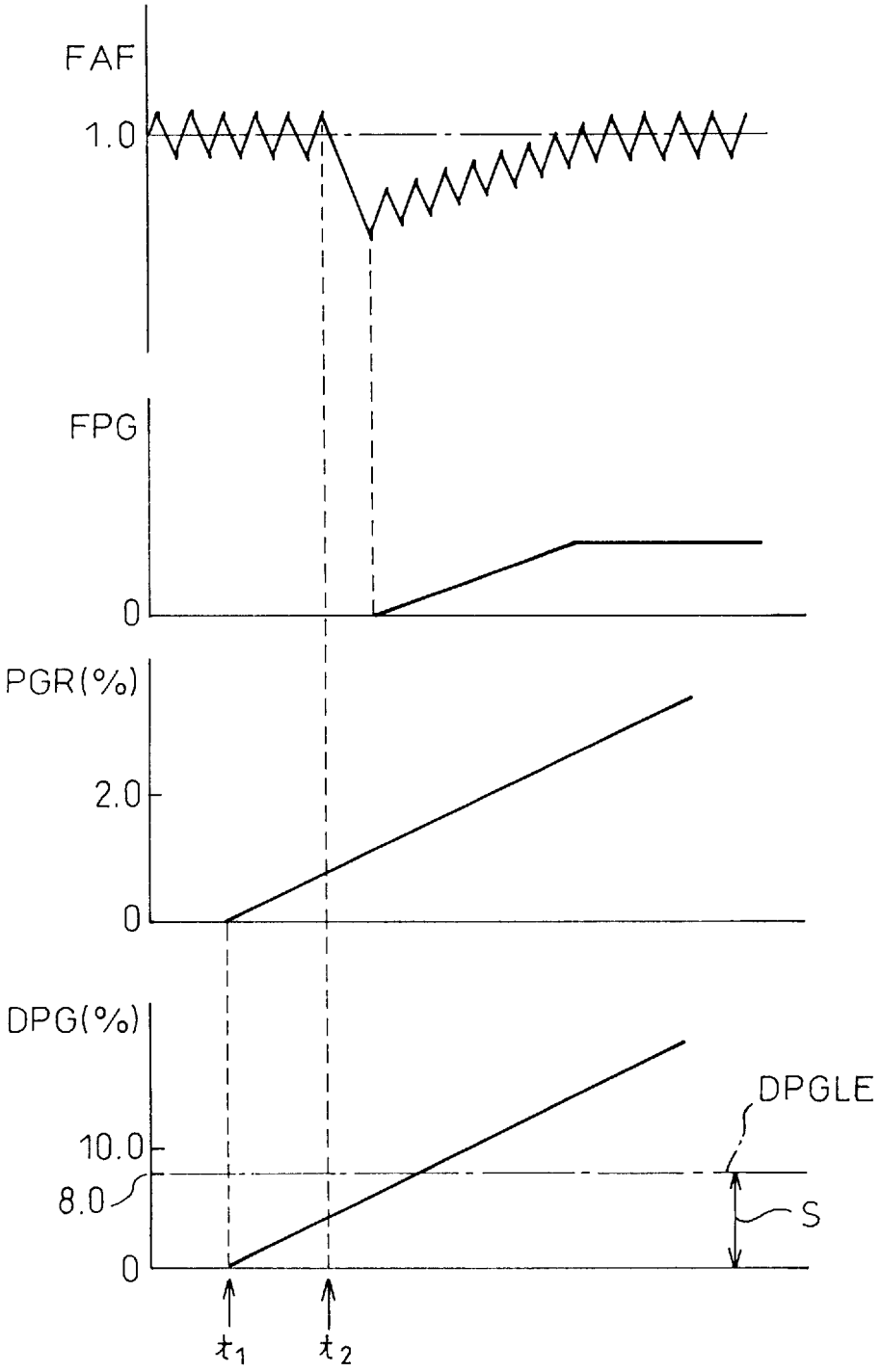
FIG. 4 is a time chart of the purge control.

FIG. 4 shows the changes in the feedback control coefficient FAF, the changes in the purge A/F correction coefficient FPG, the changes in the purge rate PGR, and the changes in the duty ratio DPG of the drive pulse. In FIG. 4, $t_1$ shows the time of the start of the purge, therefore, from FIG. 4, when the purge is started, the duty ratio DPG of the drive pulse is gradually increased, so the purge ratio PGR is gradually increased, it is seen. Even if the duty ratio DPG is gradually increased in this way, the purge control valve 17 remains closed.

On the other hand, the time $t_2$ of FIG. 4 shows when the purge control valve 17 rapidly opens. If the purge control valve 17 rapidly opens, a large amount of fuel vapor is rapidly supplied into the surge tank 5, so the air-fuel ratio becomes rich and therefore the feedback control coefficient FAF for making the air-fuel ratio the stoichiometric air-fuel ratio continues to fall. At this time, if the amount of intake air is large, the air-fuel ratio will not become that rich, but if the amount of intake air is small, the air-fuel ratio will be very rich. If the air-fuel ratio becomes very rich, the engine speed will fluctuate and further the exhaust emission will deteriorate. Therefore, in the present invention, the purge action of the fuel vapor is prevented from beginning at the time of engine idling when the amount of intake air is small. Note that FIG. 4 shows when the purge action of the fuel vapor is begun when the engine is not idling.

As shown in FIG. 4, if the purge control valve 17 is made to rapidly open and thereby the FAF falls and then the FAF begins to rise, that is, after the FAF falls, the air-fuel ratio starts to be held at the stoichiometric air-fuel ratio, the purge A/F correction coefficient FPG will gradually increase and along with this FAF will gradually return to 1.0. Next, if FAF starts to fluctuate around 1.0, the purge A/F correction coefficient FPG will be held substantially constant. The value of the purge A/F correction coefficient FPG at this time shows the amount of fluctuation of the air-fuel ratio due to the purge of the fuel vapor. Next, when the purge action is stopped and then the purge action is restarted, the value of the FPG at the time the purge was stopped is used as the value of the purge A/F correction coefficient FPG and the value of the DPG at the time the purge was stopped is used as the value of the duty ratio DPG of the drive pulse.

Next, an explanation will be made of the routine for control of the purge with reference to FIG. 5 to FIG. 7. Note that this routine is executed by interruption every predetermined time.

Figure 5:
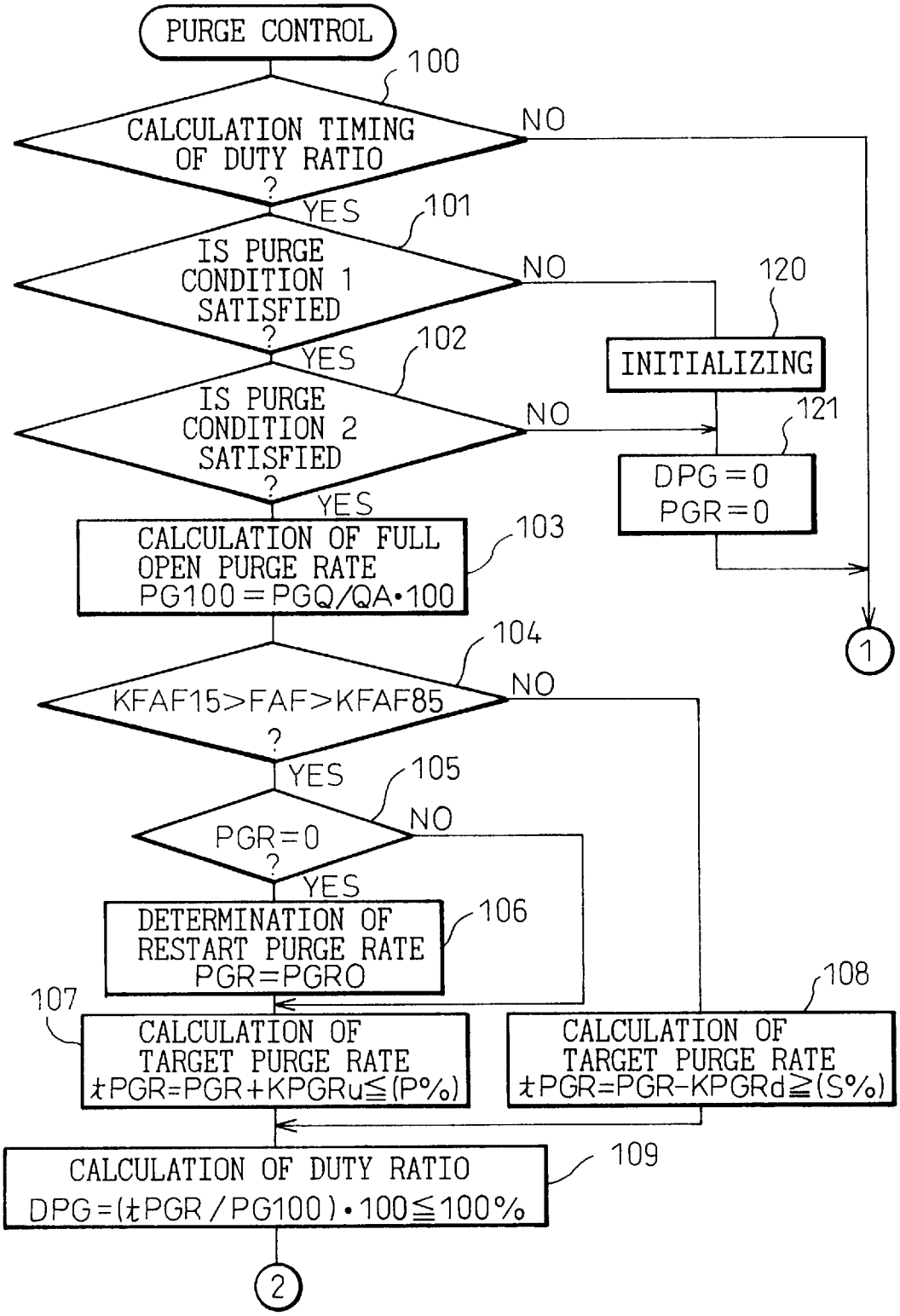
FIGS. 5 and 6 are flow charts for executing a first embodiment of the purge control.
Figure 6:
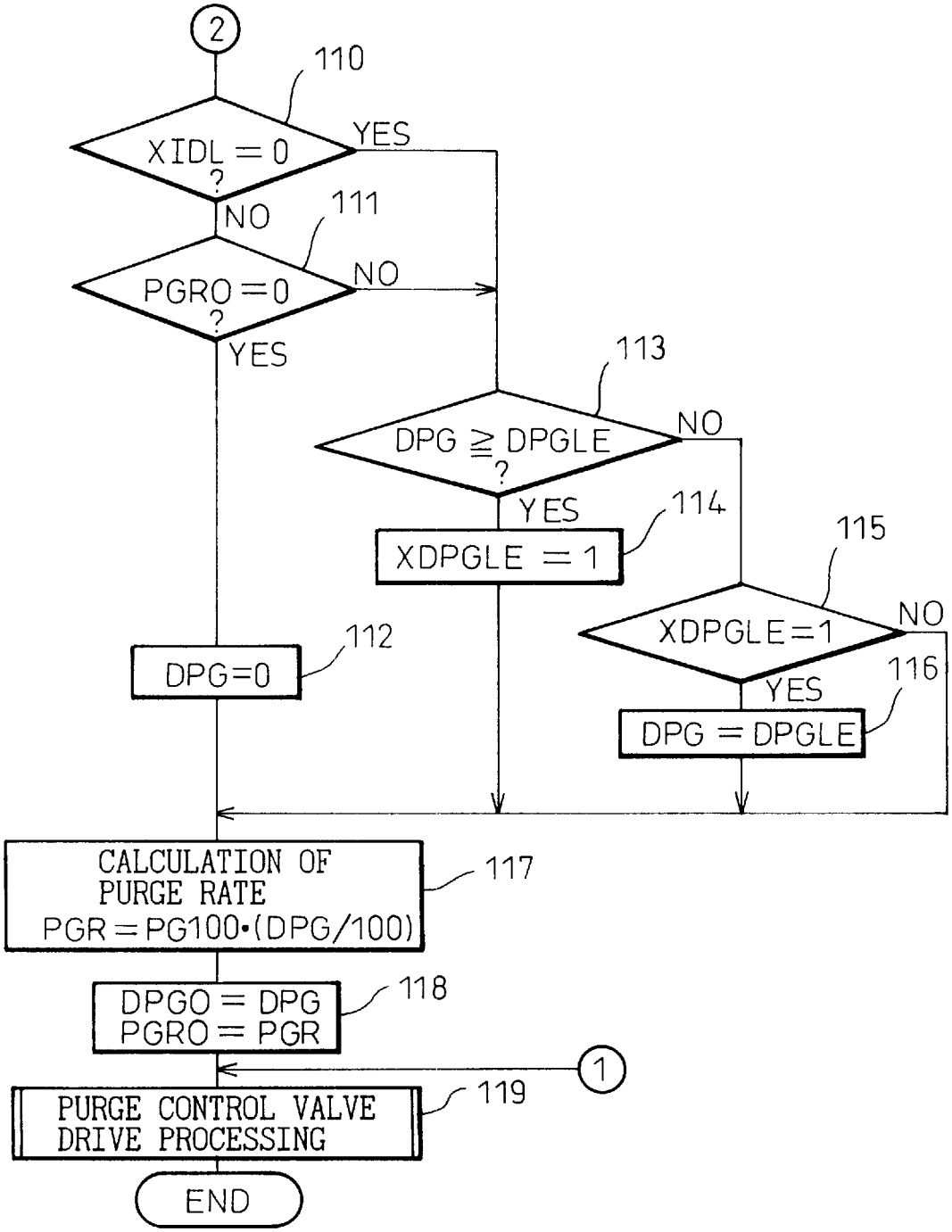

Referring to FIG. 5 and FIG. 6, first, at step 100, it is judged whether the time is the time of calculation of the duty ratio of the drive pulse of the purge control valve 17 or not. In the embodiment according to the present invention, the duty ratio is calculated every 100 msec. When not the time for calculation of the duty ratio, the routine jumps to step 118, where the processing for driving the purge control valve 17 is executed. As opposed to this, when it is the time for calculation of the duty ratio, the routine proceeds to step 101, where it is judged if the purge condition 1 is satisfied or not, for example, if the engine warmup has been completed or not. When the purge condition 1 is not satisfied, the routine proceeds to step 119, where the initialization processing is performed, then at step 120, the duty ratio DPG and the purge rate PGR are made zero. As opposed to this, when the purge condition 1 is satisfied, the routine proceeds to step 102, where it is judged if the purge condition 2 is satisfied or not, for example, whether feedback control of the air-fuel ratio is being performed or not. When the purge condition 2 is not satisfied, the routine proceeds to step 120, while when the purge condition 2 is satisfied, the routine proceeds to step 103.

At step 103, the ratio between the full open purge amount PGQ and the amount QA of intake air, that is, the full open purge rate PG100 (=(PGQ/QA)·100) is calculated. Here, the full open purge amount PGQ shows the amount of purge when the purge control valve 17 is fully open. The full open purge rate PG100 is a function of for example the engine load Q/N (amount QA of intake air/engine speed N) and the engine speed N and is found in advance by experiments. It is stored in advance in the ROM 22 in the form of a map as shown in the following table.

TABLE 1

| | Q/N | | | | | | | | | | |
|---|---|---|---|---|---|---|---|---|---|---|---|
| N | 0.15 | 0.30 | 0.45 | 0.60 | 0.75 | 0.90 | 1.05 | 1.20 | 1.35 | 1.50 | 1.65 |
| 400 | 25.6 | 25.6 | 21.6 | 15.0 | 11.4 | 8.6 | 6.3 | 4.3 | 2.8 | 0.8 | 0 |
| 800 | 25.6 | 16.3 | 10.8 | 7.5 | 5.7 | 4.3 | 3.1 | 2.1 | 1.4 | 0.4 | 0 |
| 1600 | 16.6 | 8.3 | 5.5 | 3.7 | 2.8 | 2.1 | 1.5 | 1.2 | 0.9 | 0.3 | 0 |
| 2400 | 10.6 | 5.3 | 3.5 | 2.4 | 1.8 | 1.4 | 1.1 | 0.8 | 0.6 | 0.3 | 0.1 |
| 3200 | 7.8 | 3.9 | 2.5 | 1.8 | 1.4 | 1.1 | 0.9 | 0.6 | 0.5 | 0.4 | 0.2 |
| 4000 | 6.4 | 3.2 | 2.1 | 1.5 | 1.2 | 0.9 | 0.7 | 0.6 | 0.4 | 0.4 | 0.3 |

The lower the engine load Q/N becomes, the larger the full open purge amount PGQ with respect to the amount QA of intake air becomes, so as shown in Table 1, the full open purge rate PG100 becomes larger the lower the engine load QIN becomes and the full open purge amount PGQ with respect to the amount QA of intake air becomes larger the lower the engine speed N becomes, so as shown in Table 1, the full open purge rate PG100 becomes larger the lower the engine speed N.

Next, at step 104, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 105, where it is judged whether the purge rate PGR is zero or not. That is, when the purge action is being performed, PGR>0, so at this time the routine jumps to step 107. As opposed to this, when the purge action has not started, the routine proceeds to step 106, where the purge rate PGR0 is made the restart purge rate PGR. When the purge condition 1 and the purge condition 2 are satisfied for the first time since the start of operation of the engine, the purge rate PGR0 is made zero by the initialization processing (step 120), so at this time PGR=0. As opposed to this, when the purge action has been suspended once and then the purge control is resumed, the purge rate PGR0 at the time when the purge control had been suspended is made the restart purge rate PGR.

Next, at step 107, the target purge rate tPGR (=PGR+KPRGu) is calculated by adding a constant value KPGRu to the purge rate PGR. That is, when KFAF15>FAF >KFAF85, it is understood, the target purge rate tPGR is gradually increased every 100 msec. Note that an upper limit value P (P is for example 6%) is set for this target purge rate tPGR, therefore the target purge rate tPGR can only rise up to this upper limit value P. Next, the routine proceeds to step 109.

On the other hand, when it is judged at step 104 that FAF>KFAF15 or FAF<KFAF85, the routine proceeds to step 108, where the constant value KPGRd is subtracted from the purge rate PGR to calculate the target purge rate tPGR (=PGR-KPGRd). That is, when the air-fuel ratio cannot be maintained at the stoichiometric air-fuel ratio due to the purge action of the fuel vapor, the target purge rate tPGR is reduced. Note that a lower limit value S (S=0%) is set for the target purge rate tPGR. Next, the routine proceeds to step 109.

At step 109, the target purge rate tPGR is divided by the full open purge rate PG100 to calculate the duty ratio DPG (=(tPGR/PG100)·100) of the drive pulse of the purge control valve 17. Therefore, the duty ratio DPG of the drive pulse of the purge control valve 17, that is, the amount of opening of the purge control valve 17, is controlled in accordance with the ratio of the target purge rate tPGR to the full open purge rate PG100. If the amount of opening of the purge control valve 17 is controlled in accordance with the ratio of the target purge rate tPGR to the full open purge rate PG100 in this way, no matter what purge rate the target purge rate tPGR is, regardless of the engine operating state, the actual purge rate will be maintained at the target purge rate and therefore the air-fuel ratio will no longer fluctuate.

Suppose for example that the target purge rate tPGR is 2 percent and the full open purge rate PG100 at the current operating state is 10 percent. The duty ratio DPG of the drive pulse will become 20 percent and the actual purge rate at this time will become 2 percent. Next, supposing that the operating state changes and the full open purge rate PG100 at the changed operating state becomes 5 percent, the duty ratio DPG of the duty ratio will become 40 percent and the actual purge ratio at this time will become 2 percent. That is, if the target purge rate tPGR is 2 percent, the actual purge rate will become 2 percent regardless of the engine operating state. If the target purge rate tPGR changes and becomes 4 percent, the actual purge rate will be maintained at 4 percent regardless of the engine operating state.

Next, at step 110, it is judged based on the output signal of the throttle switch 28 if the idling flag XIDL, which is set when the throttle valve 9 is at the idling opening position, has been reset (XIDL=0) or not. When the idling flag XIDL is set, that is, when the engine is idling, the routine proceeds to step 111, where it is judged if the purge rate PGR0 previously calculated is zero or not. As explained above, when the purge condition 1 and the purge condition 2 are satisfied for the first time after the engine has started to be operated, the purge rate PGR0 is zero, therefore at this time, the routine proceeds to step 112. At step 112, the duty ratio DPG is made zero. That is, when the conditions for purging are satisfied for the first time after the engine has started being operated, when the engine is idling, the duty ratio DPG is made zero and therefore the purge action of fuel vapor is stopped.

Figure 15A:
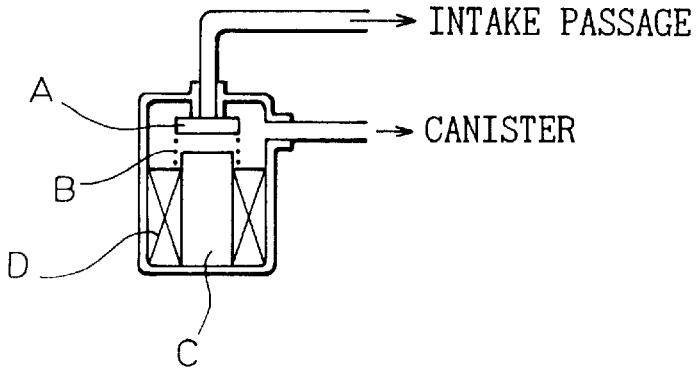
FIGS. 15A and 15B are views of the relationship between the duty ratio of a drive pulse of a purge control valve and the flow rate of purge.
Figure 15B:
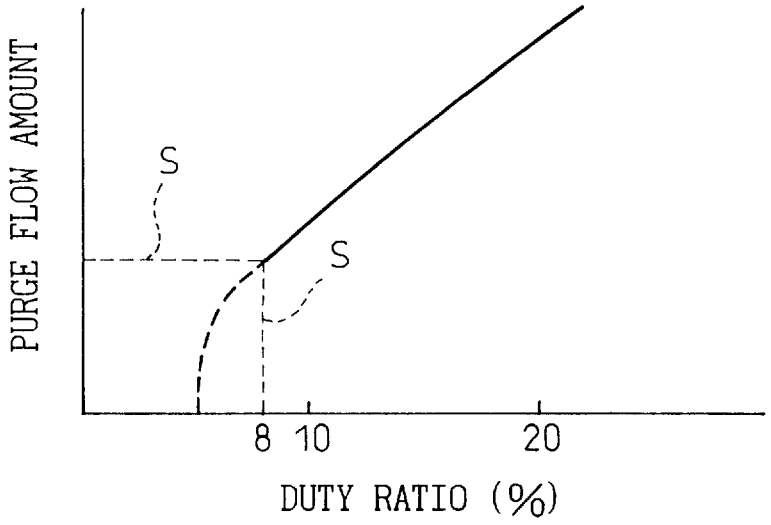

On the other hand, when it is judged at step 110 that the idling flag XIDL has been reset, that is, when the engine is not idling, the routine proceeds to step 113, where it is judged if the duty ratio DPG is larger than the minimum duty ratio DPGLE of stable flow of the purge control valve 17 or not. Here, an explanation will be given of the minimum duty ratio DPGLE of the purge control valve 17 referring to FIG. 15A and FIG. 15B.

As explained in the beginning, in a purge control valve 17, for the valve body A to open, an electromagnetic force of attraction enough to overcome the spring force of the spring B and the force of attraction of the negative pressure acting on the top center of the valve body A is necessary, therefore the valve body A will not open unless the duty ratio DPG becomes larger enough. Further, when the valve body A opens, the amount of opening of the valve body A will become larger all at once. Further, when the duty ratio DGP is small, the time for generation of the drive pulse is short, so the valve body A will not completely open and the position of the valve body A at this time will not be set, so the flow rate of purge will become unstable. The region where the flow rate of purge becomes unstable is the region enclosed by the broken lines S. In the purge control valve 17 used in the present invention, the region of unstable flow is one of a duty ratio DPG of less than 8 percent.

In the region S of unstable flow, if the duty ratio DPG exceeds a certain value, the valve body A will open all at once and therefore a large amount of fuel vapor will be purged rapidly in the intake passage, so the air-fuel ratio will temporarily become rich. If the air-fuel ratio temporarily becomes rich, the duty ratio DPG will be reduced to lower the flow rate of purge. If the duty ratio DPG falls below a certain value, the valve body A will rapidly close. As a result, the purge action of the fuel vapor will be rapidly stopped and the air-fuel ratio will become lean. If the air-fuel ratio becomes lean, the duty ratio DPG will be increased again to increase the flow rate of purge. If the duty ratio DPG exceeds a certain value, the valve body A will open all at once. In this way, the air-fuel ratio will fluctuate between rich and lean.

If this type of fluctuation of the air-fuel ratio occurs, the engine speed will fluctuate. It is therefore preferable to avoid this fluctuation. Therefore, in this embodiment of the present invention, after the duty ratio DPG once exceeds the minimum duty ratio DPGLE, the duty ratio DPG is kept from falling below the minimum duty ratio DPGLE. This control of the duty ratio DPG is performed from step 113 to step 116 of FIG. 6.

That is, when it is judged at step 113 that DPG≧DPGLE, the routine proceeds to step 114, where the duty ratio lower limit flag XDPGLE showing that the duty ratio DPG after the start of the purge exceeded the minimum duty ratio DPGLE is set (XDPGLE=1). Next, the routine proceeds to step 117.

On the other hand, when DPG<DPGLE, the routine proceeds to step 115, where it is judged if the duty ratio lower limit flag XDPGLE has been set or not. When the duty ratio lower limit flag XDPGLE has been set, the routine proceeds to step 116, where the minimum duty ratio DPGLE is made the duty ratio DPG. That is, if the duty ratio DPG exceeds the minimum duty ratio DPGLE once after the purge action has started, even if the target duty ratio tDPG becomes smaller and the duty ratio DPG becomes smaller than the minimum duty ratio DPGLE, the duty ratio DPG will be maintained at the minimum duty ratio DPGLE and therefore the duty ratio DPG will not intrude into the region S of unstable flow.

As opposed to this, when it is judged at step 115 that the duty ratio lower limit flag XDPGLE has not been set, that is, when the duty ratio DPG has not yet exceeded the minimum duty ratio DPGLE after the start of the purge action, the routine jumps to step 117. Therefore, at this time, the duty ratio calculated at step 109 is made the duty ratio DPG as it is.

On the other hand, when it is judged at step 111 that RGRO is not zero, that is, when the purge action has started, the routine proceeds to step 113, where the purge action is continued. That is, even during engine idling, if the purge action has already started, the purge action will be continued as it is.

At step 117, the actual purge rate PGR (=PG100·(DPG/100)) is calculated by multiplying the duty ratio DPG with the full open purge rate PG100. That is, as explained above, the duty ratio DPG is expressed by (tPGR/PG100)·100. In this case, if the target purge rate tPGR becomes larger than the full open purge rate PG100, the duty ratio DPG would become over 100 percent. The duty ratio DPG, however, cannot become over 100 percent. At this time, the duty ratio DPG is made 100 percent, so the actual purge rate PGR becomes smaller than the target purge rate tPGR. Therefore, the actual purge rate PGR is expressed as explained above as PG100·(DPG/100).

Next, at step 118, the duty ratio DPG is made DPG0 and the purge rate PGR is made PGR0. Next, at step 119, the processing for driving the purge control valve 17 is performed. This drive processing is shown in FIG. 7. According, the drive processing shown in FIG. 7 will be explained next.

Figure 7:
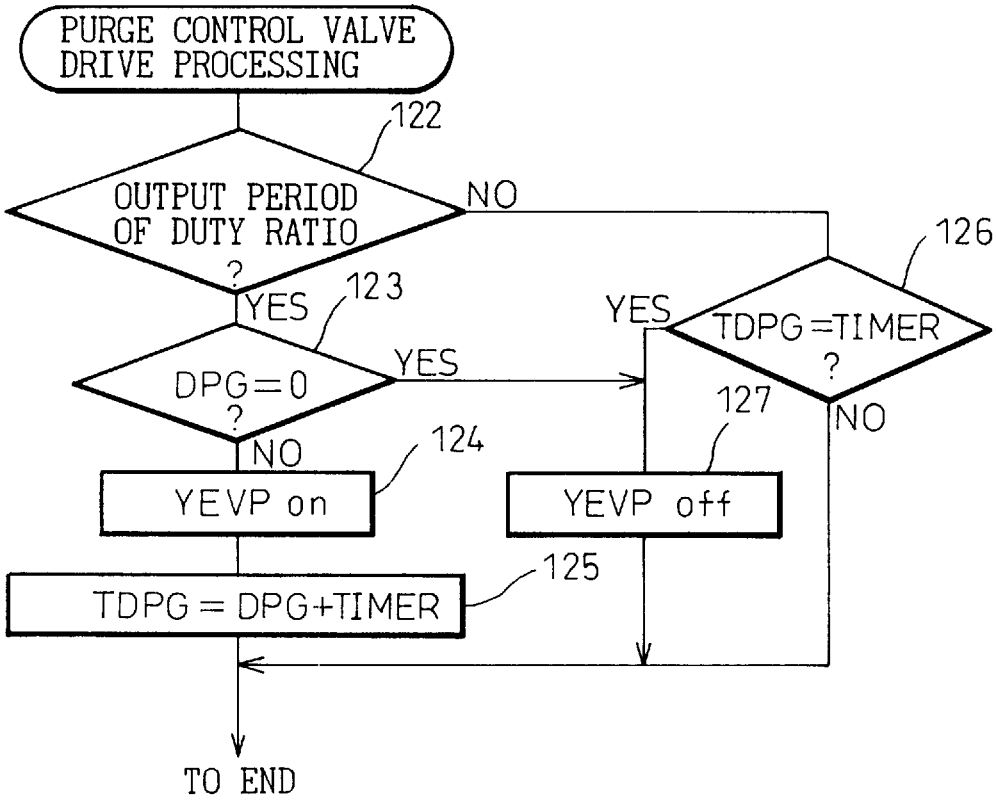
FIG. 7 is a flow chart for the processing for driving the purge control valve.

Referring to FIG. 7, first, at step 122, it is judged if the time is the output period of the duty ratio or not, that is, if it is the rising period of the drive pulse of the purge control valve 17. The output period of the duty ratio is 100 msec. When it is the output period of the duty ratio, the routine proceeds to step 123, where it is judged if the duty ratio DPG is zero or not. When DPG=0, the routine proceeds to step 127, where the drive pulse YEVP of the purge control valve 17 is turned off. As opposed to this, when DPG is not zero, the routine proceeds to step 124, where the drive pulse YEVP of the purge control valve 17 is turned on. Next, at step 125, the duty ratio DPG is added to the current time TIMER to calculate the time TDPG (=DPG+TIMER) of the drive pulse.

On the other hand, when it is judged at step 122 that the time is not the output period of the duty ratio, the routine proceeds to step 126, where it is judged if the current time TIMER is the off time TDPG of the drive pulse. When TDPG=TIMER, the routine proceeds to step 127, where the drive pulse YEVP is turned off.

Figure 8:
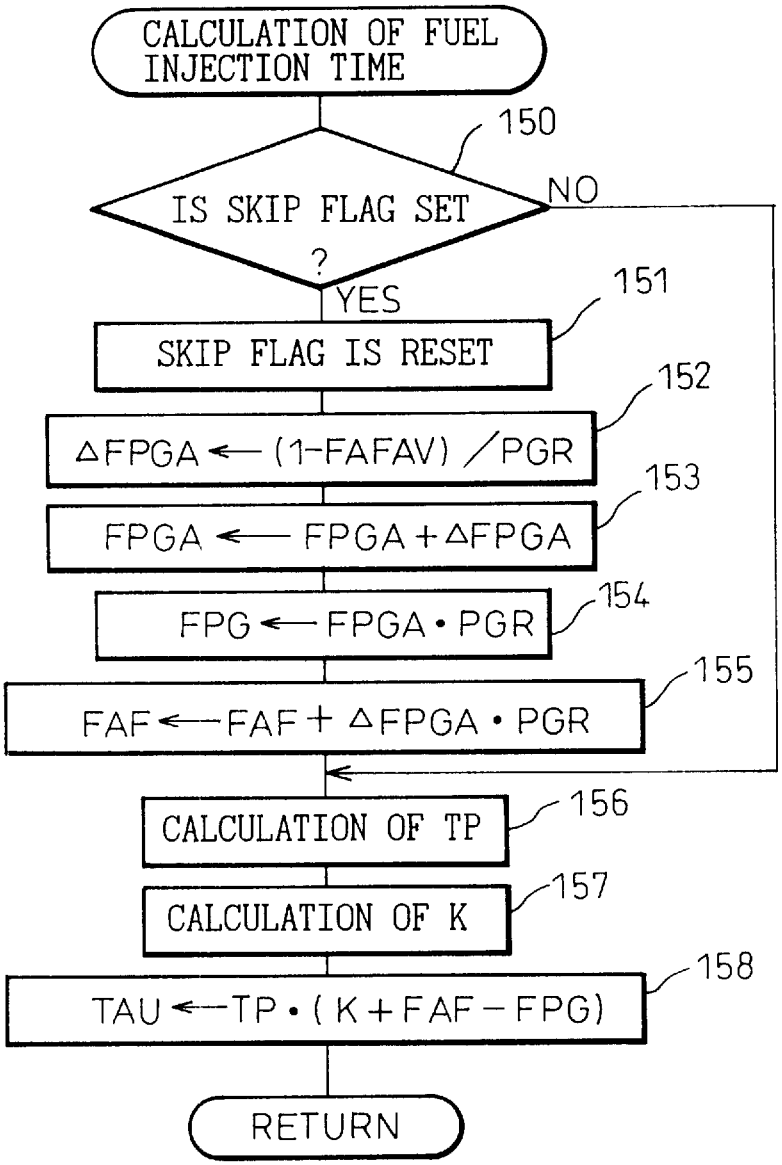
FIG. 8 is a flow chart for calculating a fuel injection time.

FIG. 8 shows the routine for calculation of the fuel injection time TAU. This routine is executed repeatedly.

Referring to FIG. 8, first, at step 150, it is judged if the skip flag which is set at step 45 of FIG. 2 has been set or not. When the skip flag has not been set, the routine jumps to step 156. As opposed to this, when the skip flag has been set, the routine proceeds to step 151, where the skip flag is reset, then the routine proceeds to step 152, where the purge vapor concentration ΔFPGA per unit purge rate is calculated based on the following formula:

$$\Delta FPGA=(1-FAFAV)/PGR$$

That is, the amount of fluctuation (1−FAFAV) of the average air-fuel ratio FAFAV shows the purge vapor concentration therefore by dividing (1−FAFAV) by the purge rate PGR, the purge vapor concentration ΔFPGA per unit purge rate is calculated. Next, at step 153, the purge vapor concentration ΔFPGA is added to the purge vapor concentration FPGA to update the purge vapor concentration FPGA per unit purge rate. When FAFAV approaches 1.0, AFPGA approaches zero, therefore FPGA approaches a constant value. Next, at step 154, the purge rate PGR is multiplied with FPGA to calculate the purge A/F correction coefficient FPG (=FPGA·PGR). Next, at step 155, ΔFPGA·PGR is added to FAF so as to increase the feedback control coefficient FAF by exactly the amount of the increase of the purge A/F correction coefficient FPG. Next, at step 156, the basic fuel injection time TP is calculated, then at step 157, the correction coefficient K is calculated, then at step 158, the injection time TAU (=TP·(k+FAF=FPG)) is calculated. That is, when the purge action is started, the injection time TAU is corrected by the purge A/F correction coefficient so that the air-fuel ratio is maintained at the stoichiometric air-fuel ratio.

Figure 9:
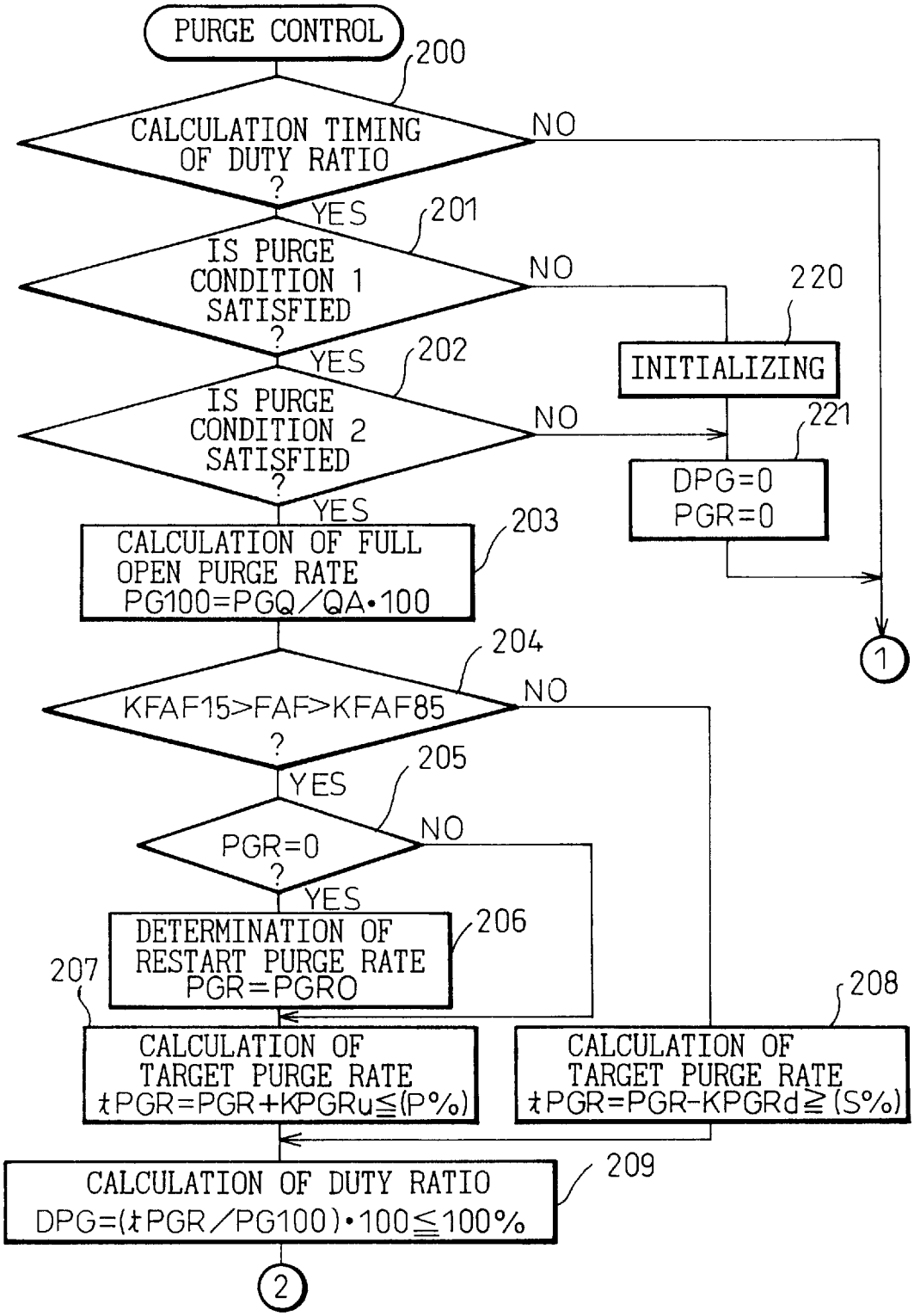
FIGS. 9 and 10 are flow charts for the execution of a second embodiment of the purge control.
Figure 10:
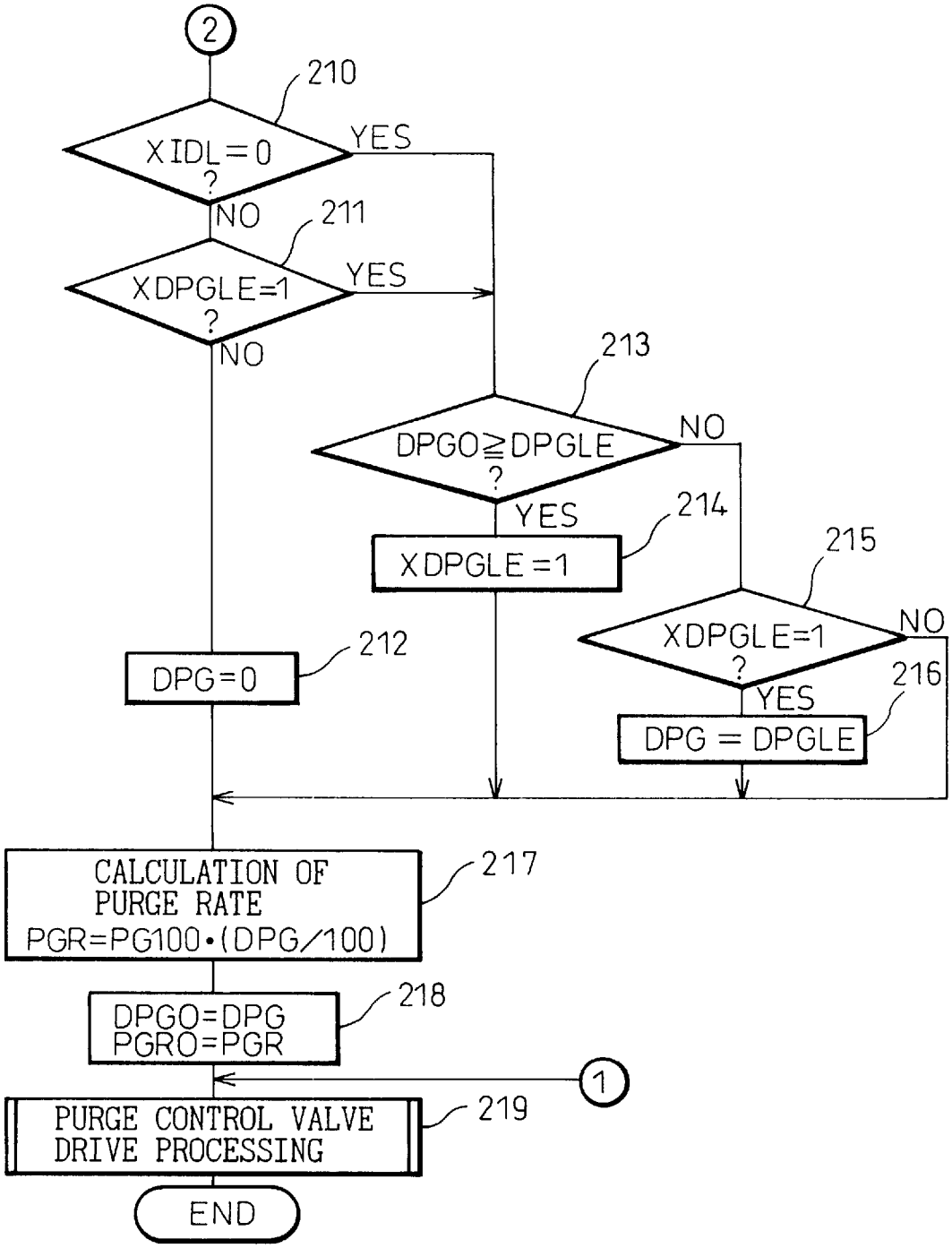

A second embodiment of the present invention will be explained next referring to FIG. 9 and FIG. 10. Step 200 to step 209 and step 217 to step 221 of FIG. 9 and FIG. 10 correspond to step 100 to step 109 and step 117 to step 121 of FIG. 5 and FIG. 6. The difference from FIG. 5 and FIG. 6 in FIG. 9 and FIG. 10 is step 210 to step 216. Therefore, the explanation of step 200 to step 209 and step 217 to step 221 in FIG. 9 and FIG. 10 will be omitted and just step 210 to step 216 will be explained below.

In this embodiment as well, when the conditions for the purge are first satisfied after the engine started, the purge action is prohibited when the engine is idling. Next, when the engine is no longer idling, the purge action of the fuel vapor is started. When the duty ratio DPG then becomes larger than the mininum duty ratio DPGLE, the purge action during engine idling is authorized. That is, once the duty ratio DPG exceeds the minimum duty ratio DPGLE, the purge action of the fuel vapor is performed even during engine idling.

That is, referring to FIG. 9 and FIG. 10, at step 210, it is judged if the idling flag XIDL is reset (XIDL=0) or not. When the idling flag XIDL is set, that is, when the engine is idling, the routine proceeds to step 211, where it is judged if the duty ratio lower limit flag XDPGLE showing that the duty ratio DPG exceeded the minimum duty ratio DPGLE after the start of purge is set or not. When the purge condition 1 and the purge condition 2 are satisfied for the first time after the engine started to be operated, the duty ratio lower limit flag XDPGLE is not set, therefore at this time the routine proceeds to step 212. At step 212, the duty ratio DPG is made zero. That is, when the conditions for purge are satisfied for the first time after the start of the operation of the engine, the duty ratio DPG is made zero, therefore the purge action of the fuel vapor is stopped.

On the other hand, when it is judged at step 210 that the idling flag XIDL is reset, that is, when the engine is not idling, the routine proceeds to step 213, where it is judge if the previously calculated duty ratio DPG0 is larger than the minimum duty ratio DPGLE of stable flow of the purge control valve 17. When it is judged that DPG0≧DPGLE, the routine proceeds to step 214, where the duty ratio lower limit flag XDPGLE is set (XDPGLE=1). Next, the routine proceeds to step 217.

On the other hand, when DPG0<DPGLE, the routine proceeds to step 215, where it is judged if the duty ratio lower limit flag XDPGLE has been set or not. When the duty ratio lower limit flag XDGLE has been set, the routine proceeds to step 216, where the minimum duty ratio DPGLE is made the duty ratio DPG. That is, once the duty ratio DPG0 exceeds the minimum duty ratio DPGLE after the start of the purge action, even if the target purge rate tPGR becomes smaller and the duty ratio DPG0 becomes smaller than the minimum duty ratio DPGLE, the duty ratio DPG will be maintained at the minimum duty ratio DPGLE and thereby the duty ratio will be prevented from entering the region S of unstable flow.

As opposed to this, when it is judged at step 215 that the duty ratio lower limit flag XDPGLE has not be set, that is, when the duty ratio DPG has not yet exceeded the minimum duty ratio DPGLE after the start of the purge action, the routine jumps to step 217. Therefore, at this time, the duty ratio calculated at step 209 is made the duty ratio DPG as it is. On the other hand, if the duty ratio lower limit flag XDPGLE is set, even if the engine is idling, the routine will proceed from step 211 to step 213, so the purge action of the fuel vapor will be performed.

Next, an explanation will be made of a third embodiment of the present invention referring to FIG. 11 and FIG. 12. Note that step 300 to step 309 and step 319 to step 323 of FIG. 11 and FIG. 12 correspond to step 100 to step 109 and step 117 to step 121 of FIG. 5 and FIG. 6. The difference from FIG. 5 and FIG. 6 in FIG. 9 and FIG. 10 is step 310 to step 318. Therefore, the explanation of step 300 to step 309 and step 319 to step 323 in FIG. 11 and FIG. 12 will be omitted and just step 310 to step 318 will be explained below.

In this embodiment as well, when the conditions for the purge are first satisfied after the engine started being operated, the purge action is prohibited when the engine is idling. Next, when the engine is no longer idling, the purge action of the fuel vapor is started. When the target purge rate tPGR then becomes larger than the standard purge rate KtPGR, the purge action during engine idling is authorized. That is, once the target purge rate tPGR exceeds the standard purge rate KtPGR, the purge action of the fuel vapor is performed even during engine idling.

Figure 11:
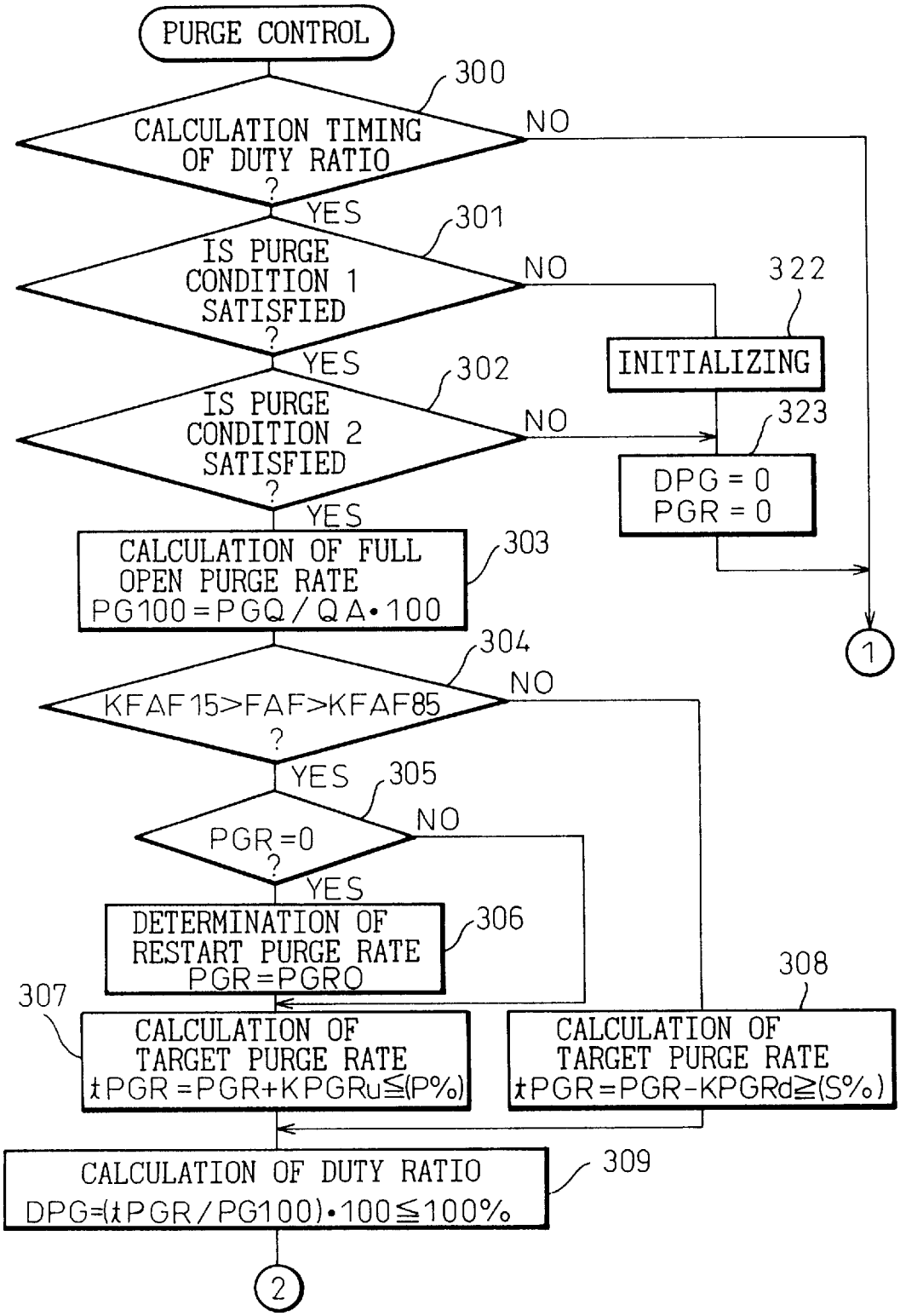
FIGS. 11 and 12 are flow charts for the execution of a third embodiment of the purge control.
Figure 12:
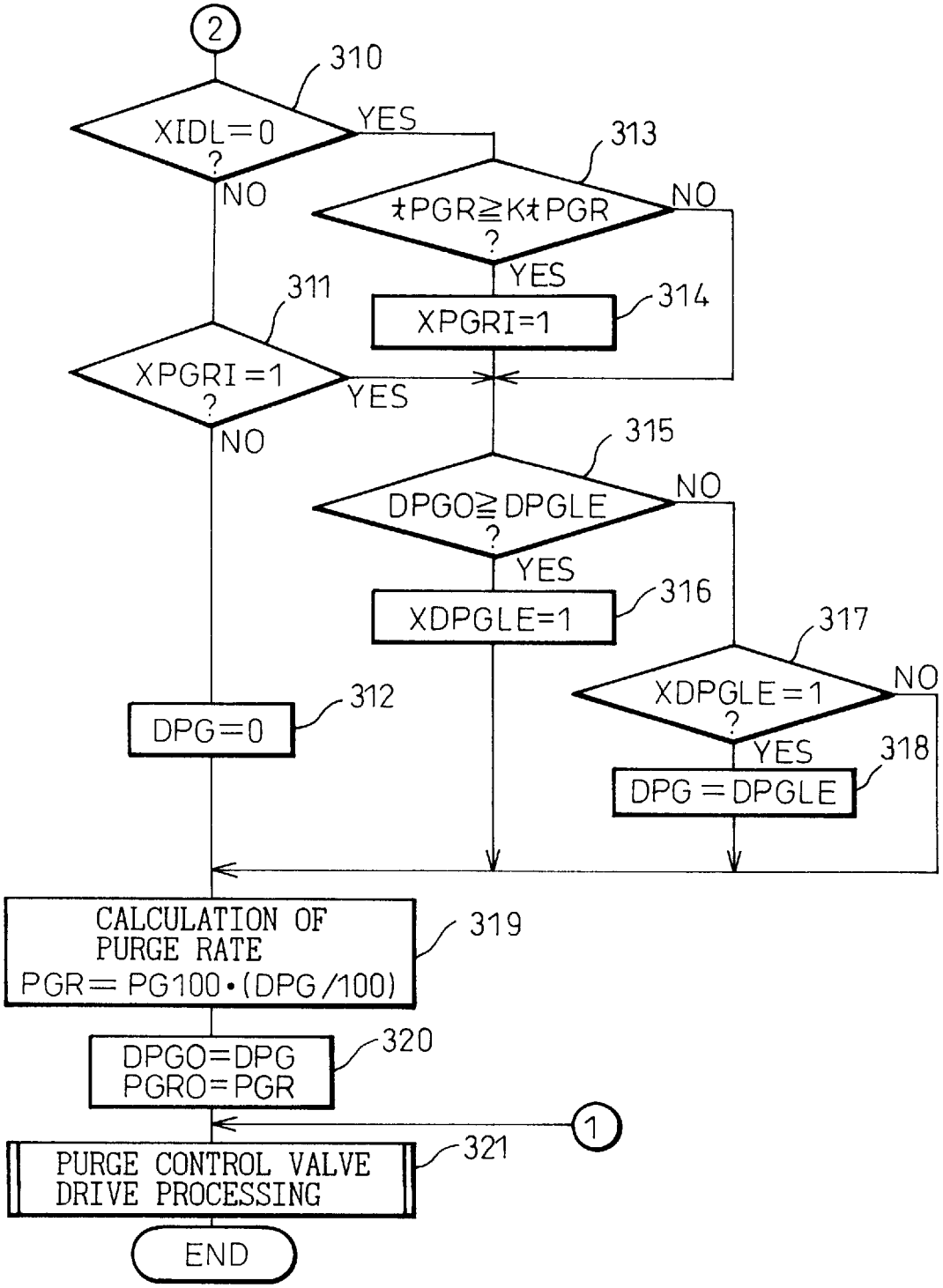

That is, referring to FIG. 11 and FIG. 12, at step 310, it is judged if the idling flag XIDL is reset (XIDL=0) or not. When the idling flag XIDL is set, that is, when the engine is idling, the routine proceeds to step 311, where it is judged if the purge authorization flag XPRGI, which is set when the target purge rate tPGR exceeds the standard purge rate after the start of the purge, is set or not. When the purge condition 1 and the purge condition 2 are satisfied for the first time after the engine started, the purge authorization flag XPGRI is not set, therefore at this time the routine proceeds to step 312. At step 312, the duty ratio DPG is made zero. That is, when the conditions for purge are satisfied for the first time after the start of the operation of the engine, when the engine is idling, the duty ratio DPG is made zero, therefore the purge action of the fuel vapor is stopped.

On the other hand, when it is judged at step 310 that the idling flag XIDL is reset, that is, when the engine is not idling, the routine proceeds to step 313, where it is judged if the target purge rate tPGR has become larger than the standard purge rate KtPGR or not. When tPGR<KtPGR, the routine jumps to step 315. As opposed to this, when tPGR>KtPGR, the routine proceeds to step 314, where the authorization flag XPGRI is set (XPGRI=1). Next, the routine proceeds to step 315.

At step 315, it is judged if the previously calculated purge rate DPGR0 is larger than the minimum duty ratio DPGLE of the stable flow of the purge control valve 17 or not. When DPG0>DPGLE, the routine proceeds to step 316, where the duty ratio lower limit flag XDPGLE showing that the duty ratio DPG has exceeded the minimum duty ratio DPGLE after the start of the purge is set (XDPGLE=1). Next, the routine proceeds to step 319.

On the other hand, when DPG0<DPGLE, the routine proceeds to step 317, where it is judged if the duty ratio lower limit flag XDPGLE is set or not. When the duty ratio lower limit flag XDPGLE is set, the routine proceeds to step 318, where the minimum duty ratio DPGLE is made the duty ratio DPG. That is, if the duty ratio DPG exceeds the minimum duty ratio DPGLE once after the purge action is started, even if the target duty ratio tDGR becomes smaller and the duty ratio DPG becomes smaller than the minimum duty ratio DPGLE, the duty ratio DPG will be maintained at the minimum duty ratio DPGLE and thereby the duty ratio DPG will be prevented from entering the region S of unstable flow.

As opposed to this, when it is judged at step 317 that the duty ratio lower limit flag XDGLE has not been set, that is, when the duty ratio DPG has not yet exceeded the minimum duty ratio DPGLE after the start of the purge action, the routine jumps to step 319. Therefore, at this time, the duty ratio calculated at step 309 is made the duty ratio DPG as it is. On the other hand, if the purge authorization flag XPGRI is set, if the engine is idling, the routine will proceed from step 311 to step 315, so the purge action of the fuel vapor will be performed.

Figure 13:
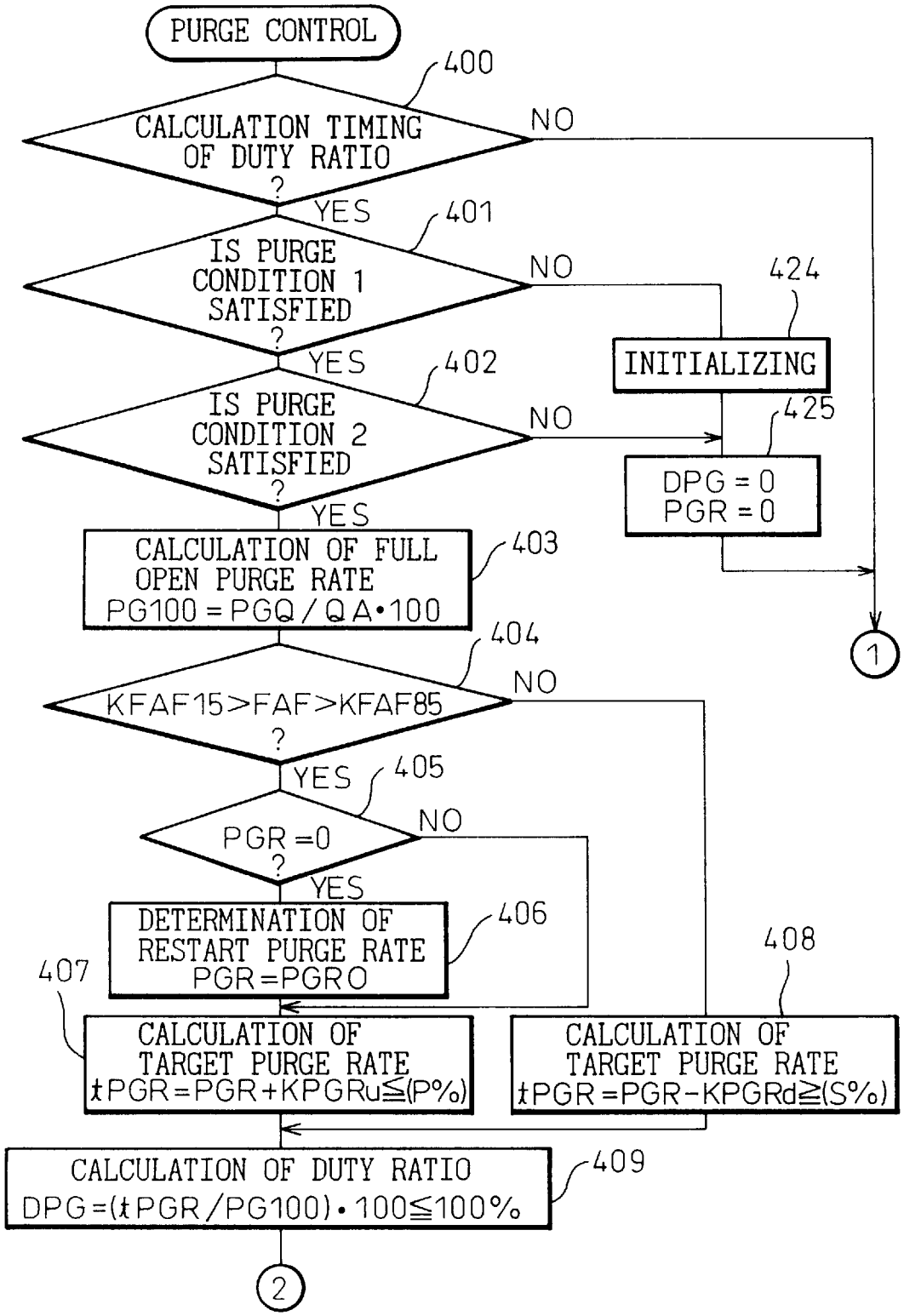
FIGS. 13 and 14 are flow charts for the execution of a fourth embodiment of the purge control.
Figure 14:
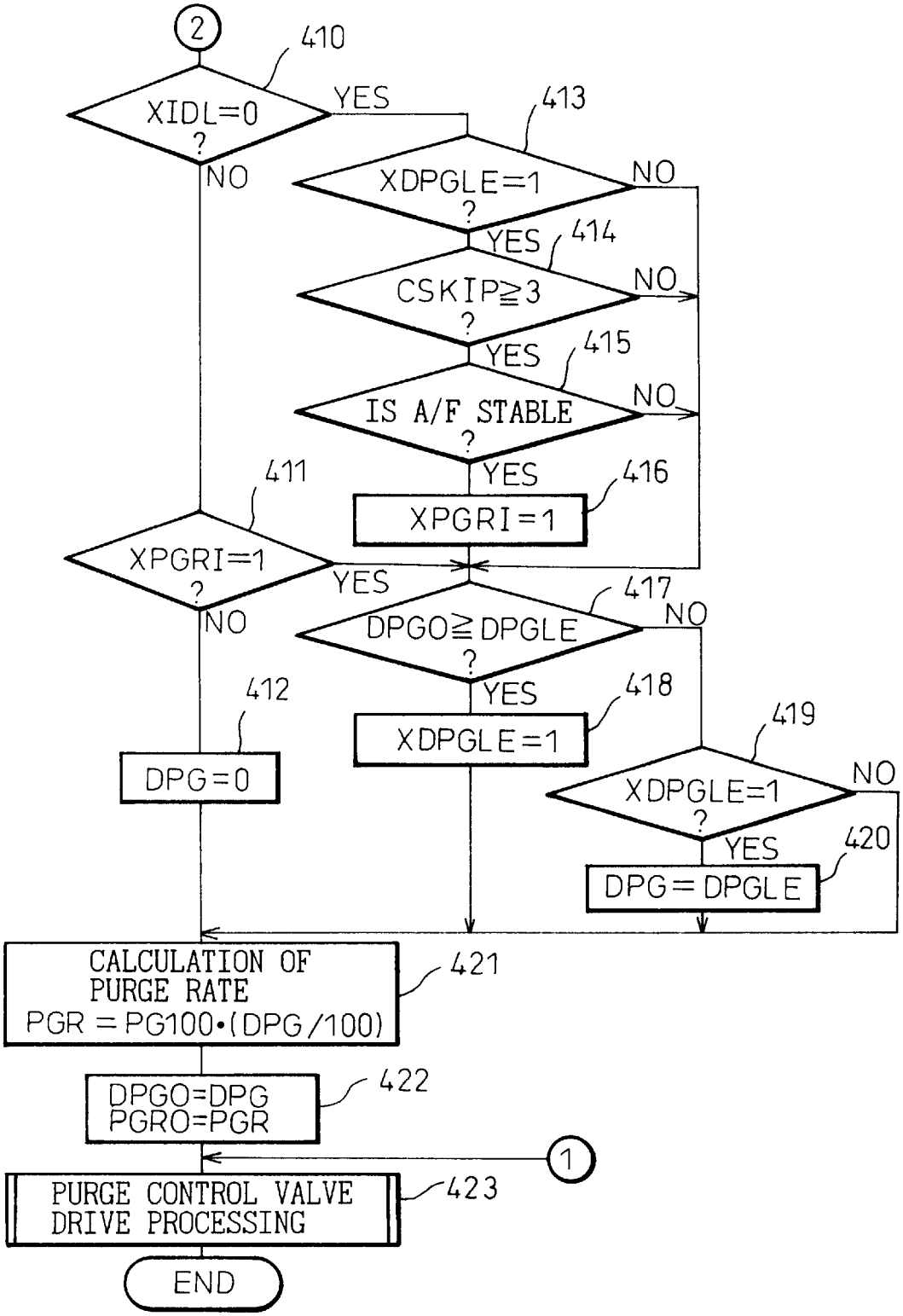

Next, an explanation will be made of a fourth embodiment of the present invention referring to FIG. 13 and FIG. 14. Note that step 400 to step 409 and step 421 to step 425 of FIG. 13 and FIG. 14 correspond to step 100 to step 109 and step 117 to step 121 of FIG. 5 and FIG. 6. The difference from FIG. 5 and FIG. 6 in FIG. 13 and FIG. 14 is step 410 to step 420. Therefore, the explanation of step 400 to step 409 and step 421 to step 425 in FIG. 13 and FIG. 14 will be omitted and just step 410 to step 420 will be explained below.

In this embodiment as well, when the conditions for the purge are first satisfied after the engine started, the purge action is prohibited when the engine is idling. Next, when the engine is no longer idling, the purge action of the fuel vapor is started. When the air-fuel ratio stabilizes, the purge action during engine idling is authorized. That is, once the air-fuel ratio stabilizes after the start of the purage action, the purge action of the fuel vapor is performed even during engine idling.

That is, referring to FIG. 13 and FIG. 14, at step 410, it is judged if the idling flag XIDL is reset (XIDL=0) or not. When the idling flag XIDL is set, that is, when the engine is idling, the routine proceeds to step 411, where it is judged if the purge authorization flag XPRGI, which is set when the air-fuel ratio stabilizes after the start of the purge, is set or not. When the purge condition 1 and the purge condition 2 are satisfied for the first time after the engine started to be operated, the purge authorization flag XPGRI is not set, therefore at this time the routine proceeds to step 412. At step 412, the duty ratio DPG is made zero. That is, when the conditions for purge are satisfied for the first time after the start of the operation of the engine, when the engine is idling, the duty ratio DPG is made zero, therefore the purge action of the fuel vapor is stopped.

On the other hand, when it is judged at step 410 that the idling flag XIDL is reset, that is, when the engine is not idling, the routine proceeds to step 413, where it is judged if the duty ratio lower limit flag DPGLE showing that the duty ratio DPG exceeded the minimum duty ratio DPGLE after the start of the purge is set (XDPGLE=1) or not. When the duty ratio lower limit flag XDPGLE has not been set, the routine jumps to step 417, while when the duty ratio lower limit flag XDPGLE has been set, the routine proceeds to step 414.

At step 414, it is judged if the skip action of the feedback correction coefficient FAF (see S in FIG. 3) has been performed by more than a certain number of times, for example, 3 or more. When the skip number CSKIP is less than 3 times, the routine jumps to step 417. As opposed to this, when the skip number CSKIP is 3 or more times, the routine proceeds to step 415, where it is judged if the feedback correction coefficient FAF is stable or not, for example, if the average value FAFAV of the feedback control coefficient is $1.02 \geqq FAFAV \geqq 0.98$ or not. $FAFAV > 1.02$ or $FAFAV < 0.98$, the routine jumps to step 417, while when $1.02 > FAFAV > 0.98$, the routine proceeds to step 416, where the purge authorization flag XPGRI is set, then the routine proceeds to step 417.

That is, if the skip number CSKIP is 3 or more after the start of the purge, it is considered that the feedback control of the air-fuel ratio is stable. Further, as understood from FIG. 4, if $1.02 \geqq FAFAV \geqq 0.98$, the calculation of the fluctuation of the air-fuel ratio due to the purge of the fuel vapor, that is, the calculation of the purge A/F correction coefficient FPG, is completed. Therefore, at this time, the air-fuel ratio does not fluctuate due to the purge action and at this time the purge authorization flag XPGRI is set.

Next, at step 417, it is judged if the previously calculated duty ratio DPG0 is larger than the minimum duty ratio DPGLE of the stable flow of the purge control valve 17. When DPG0≧DPGLE, the routine proceeds to step 418, where the duty ratio lower limit flag XDPGLE is set (XDPGLE=1). Next, the routine proceeds to step 421.

On the other hand, when DPG0<DPGLE, the routine proceeds to step 419, where it is judged if the duty ratio lower limit flag XDPGLE is set or not. When the duty ratio lower limit flag XDPGE is set, the routine proceeds to step 420, where the minimum duty ratio DPGLE is made the duty ratio DPG. That is, once the duty ratio DPG exceeds the minimum duty ratio DPGLE after the purge action is started, even if the target purge rate tPGR becomes small and the duty ratio DPG becomes smaller than the minimum duty ratio DPGLE, the duty ratio DPG will be maintained at the minimum duty ratio DPGLE and therefore the duty ratio DPG will be prevented from entering into the region S of unstable flow.

As opposed to this, when it is judged at step 419 that the duty ratio lower limit flag XDPGLE is not set, that is, when the duty ratio DPG has not yet exceeded the minimum duty ratio DPGLE after the start of the purge action, the routine jumps to step 421. Therefore, at this time, the duty ratio calculated at step 409 is made the duty ratio DPG as it is. On the other hand, purge authorization flag XPGRI is set, when the engine is idling, the routine proceeds from step 411 to step 417, so the purge action of the fuel vapor is performed.

As mentioned above, according to the present invention, it is possible to prevent the air-fuel ratio from fluctuating when the purge action is started and to increase the chances for purging.

While the invention has been described by reference to specific embodiments chosen for purposes of illustration, it should be apparent that numerous modifications could be made thereto by those skilled in the art without departing from the basic concept and scope of the invention.

I claim:

1. An evaporated fuel treatment device for an engine provided with an intake passage, comprising:

a purge control valve for controlling an amount of purge of fuel vapor to be purged to the intake passage;

air-fuel ratio detecting means for detecting the air-fuel ratio;

purge action starting means for starting a purge action of fuel vapor when the amount of intake air is larger than a predetermined amount which is greater than the amount of intake air at the time of engine idling;

valve opening controlling means for gradually opening the purge control valve from the fully closed state to a target opening degree when the purge action of the fuel vapor is started; and purge action authorizing means for authorizing a purge action of fuel vapor at the time of engine idling after the purge action of the fuel vapor has been started.

2. An evaporated fuel treatment device as set forth in claim 1, wherein the purge action starting means starts the purge action of the fuel vapor when the engine operating state is other than idling.

3. An evaporated fuel treatment device as set forth in claim 1, wherein the purge action authorizing means authorizes the purge action of the fuel vapor at the time of engine idling when, after the purge action of the fuel vapor has been started, the amount of opening of the purge control valve exceeds a predetermined amount of opening where the flow rate of the purge control valve is stable.

4. An evaporated fuel treatment device as set forth in claim 1, wherein the purge action authorizing means authorizes the purge action of the fuel vapor at the time of engine idling when, after the purge action of the fuel vapor has been started, the purge rate exceeds a predetermined purge rate.

5. An evaporated fuel treatment device as set forth in claim 1, further comprising purge vapor concentration learning means for learning the purge vapor concentration based on the amount of fluctuation of the air-fuel ratio and correcting means for correcting the amount of fuel injection so that the air-fuel ratio is maintained at the target air-fuel ratio based on the learned purge vapor concentration, where said purge action authorizing means authorizes the purge action of the fuel vaporat at the time of engine idling after the completion of learning of the purge vapor concentration by the purge vapor concentration learning means.

6. An evaporated fuel treatment device as set forth in claim 5, wherein the correcting means corrects the amount of fuel injection by a feedback correction coefficient which varies in accordance with the air-fuel ratio detected by said air-fuel ratio detecting means and where said purge action authorizing means judges that the learning of the purge vapor concentration has been completed when, after the amount of opening of the purge control valve exceeds a predetermined amount of opening where the flow rate of the purge control valve is stable, the feedback correction coefficient is maintained in a predetermined range.

7. An evaporated fuel treatment device as set forth in claim 1, further comprising judging means for judging if the amount of opening of the purge control valve has exceeded a predetermined range of unstable flow other than when the engine is idling and prohibiting means for prohibiting the reduction of the amount of opening of the purge control valve to the region of unstable flow after the amount of opening of the purge control valve exceeds the region of unstable flow.

8. An evaporated fuel treatment device as set forth in claim 7, wherein the region of unstable flow is from the fully closed state of the purge control valve to a slightly open state.

9. An evaporated fuel treatment device as set forth in claim 1, wherein the valve opening controlling means gradually increases the amount of opening of the purge control valve when the air-fuel ratio is in a predetermined air-fuel ratio region including the stoichiometric air-fuel ratio and gradually reduces the amount of opening of the purge control valve when the air-fuel ratio is outside of the air-fuel ratio region.

10. An evaporated fuel treatment device as set forth in claim 9, wherein the amount of fuel injection is corrected by a feedback control coefficient based on the air-fuel ratio detected by said air-fuel ratio detecting means so that the air-fuel ratio becomes the target air-fuel ratio and said valve opening controlling means gradually increases the amount of opening of the purge control valve when the feedback control coefficient is in a predetermined range and gradually reduces the amount of opening of the purge control valve when the air-fuel ratio is outside of the predetermined range.

11. An evaporated fuel treatment device as set forth in claim 1, wherein calculating means is provided for calculating a target purge rate and the valve opening control means gradually opens the purge control valve so that the purge rate increases along with the target purge rate.

12. An evaporated fuel treatment device as set forth in claim 11, wherein means is provided for finding a full open purge rate for when the purge control valve is fully open and the amount of opening of the purge control valve is determined by dividing the target purge rate by the full open purge rate.

* * * * *

UNITED STATES PATENT AND TRADEMARK OFFICE

CERTIFICATE OF CORRECTION

PATENT NO. : 5,806,507

DATED : September 15, 1998

INVENTOR(S) : Osanai

It is certified that error appears in the above-identified patent and that said Letters Patent is hereby corrected as shown below:

Column 1, line 38, change "the purge no long is" to - - the purge no longer is - -;

Column 6, line 65, change "QIN" to - -Q/N - -;

Column 7, line 31, change "FAF>KFAF15 or FAF<KFAF85" to
- -FAF≥KFAF15 or FAF≤KFAF85 - -;

Column 10, line 16, change "AFPGA" to --△FPGA - -;

Column 12, line 4, change "tPGR>KtPGR" to - -tPGR≥KtPGR - -;

Column 12, line 10, change "DPGO>" to - -DPGO≥ - -;

Column 12, line 54, change "purage" to - - purge - -;

Column 13, line 25, change "1.02>FAFAV>0.98" to - -1.02≥FAFAV≥0.98--;

Column 14, line 49, change "vaporat" to –vapor at–.

Signed and Sealed this

Sixth Day of February, 2001

*Attest:*

*Attesting Officer*

Q. TODD DICKINSON

*Director of Patents and Trademarks*